United States Patent [19]

Godel et al.

[11] 4,066,865

[45] Jan. 3, 1978

[54] PORTABLE HAIR DRYING APPLIANCE AND HEATING ELEMENT ASSEMBLY THEREFOR

[75] Inventors: Siegfried Godel, Norwalk; James Joseph Viola, Orange, both of Conn.

[73] Assignee: Sperry Rand Corporation, Bridgeport, Conn.

[21] Appl. No.: 645,314

[22] Filed: Dec. 29, 1975

[51] Int. Cl.[2] ..... H05B 3/02; F24H 3/04; H01C 1/082; H01C 3/10

[52] U.S. Cl. ..... 219/370; 219/375; 219/381; 219/532; 219/536; 219/546; 338/58; 338/206; 338/294; 338/321

[58] Field of Search ..... 219/365-371, 219/373-377, 379-381, 536, 541, 532, 546, 551, 542; 338/279-294, 315-321, 53-58, 206; 34/96-101, 243 R; 132/7, 9, 112

[56] References Cited

U.S. PATENT DOCUMENTS

| | | | |
|---|---|---|---|
| 760,076 | 5/1904 | Leonard | 338/319 X |
| 1,510,796 | 10/1924 | Patterson | 219/541 |
| 1,719,872 | 7/1929 | Calcott | 219/376 |
| 1,901,499 | 3/1933 | Fahrenwald | 338/290 X |
| 1,923,644 | 8/1933 | Simpson | 338/293 X |
| 2,429,733 | 10/1947 | Trent | 219/374 X |
| 2,874,258 | 2/1959 | Kuhn et al. | 338/58 |
| 3,571,566 | 3/1971 | Kuzara | 219/536 |

*Primary Examiner*—A. Bartis
*Attorney, Agent, or Firm*—Charles R. Miranda

[57] ABSTRACT

A heater assembly for an electrical appliance such as a portable hair dryer. The heater assembly includes an elongated flexible foil resistance element having opposite longitudinal edge portions mounted on spaced disc support members. T-shaped tabs extend from the foil edges and are seated in recessed portions or notches located in the periphery of the discs with the T-end portions thereof locked to the discs by detent means provided on the discs.

11 Claims, 8 Drawing Figures

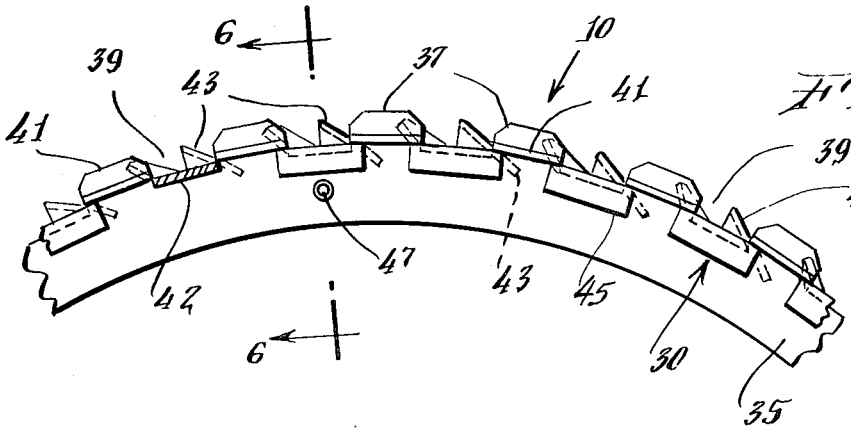
Fig. 5.
Fig. 6.
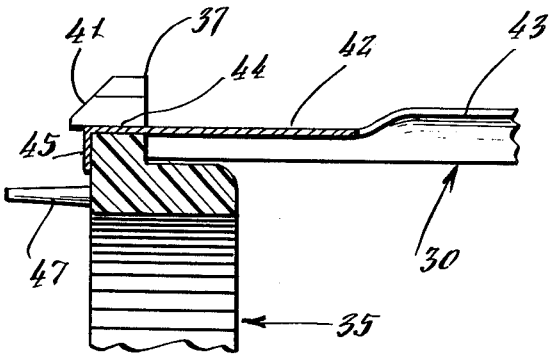
Fig. 7.
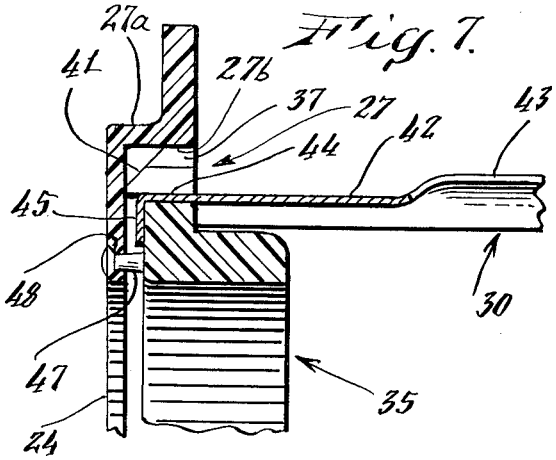
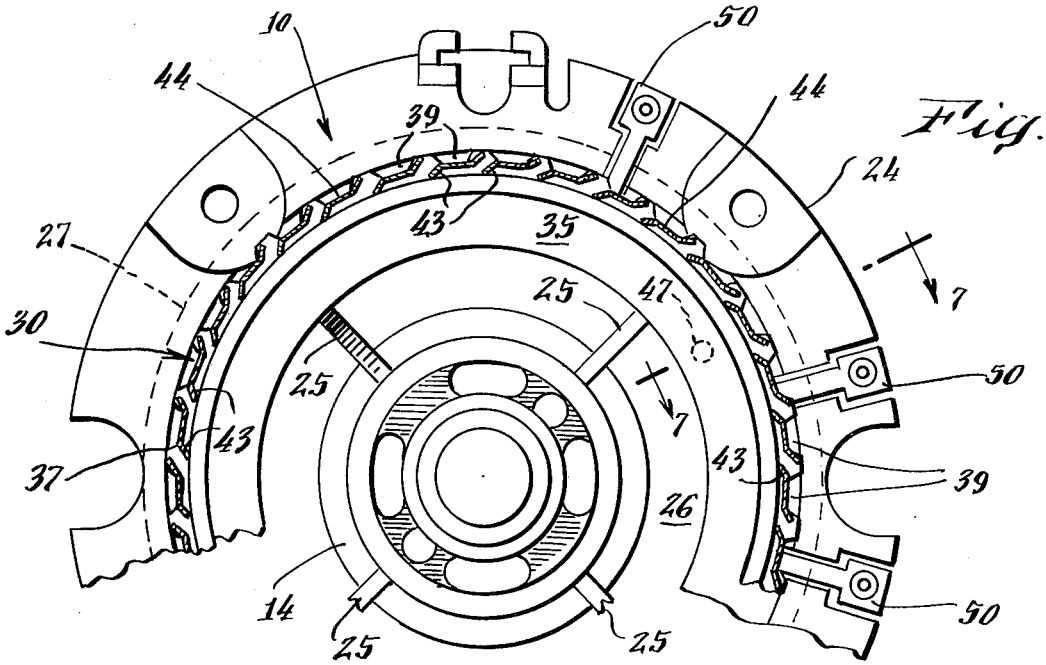
Fig. 8.

PORTABLE HAIR DRYING APPLIANCE AND HEATING ELEMENT ASSEMBLY THEREFOR

BACKGROUND OF THE INVENTION

The present invention relates to new and useful improvements in heater element assemblies and in particular to resistance type heater elements utilized in electrical appliances.

Certain type electrical appliances utilizing resistance type heater elements such as portable hair dryers for both professional and non-professional use are well-known. In one type hair dryer such as that disclosed in co-pending U.S. applications Ser. Nos. 583,619 and 583,617, filed June 4, 1975, the devices comprise an elongated casing having a handle portion at one end and discharge orifice for heated air at the opposite end. A motor driven fan assembly is provided in the casing for circulating air through a heater element and thence outwardly of the air discharge orifice. The heater element comprises an elongated flexible foil type element having spaced longitudinal edges mounted on spaced disc members and disposed over the fan impeller blade. The surface of the foil is provided with vented vane members for directing the flow of air outwardly of the heater element from the fan. In this type hair dryer the foil is an integral part of the electrical circuit and as a circuit resistance element generates heat for heating the air being controlled by suitable thermostats in a well-known manner.

In certain of these devices the opposite ends of the foil heater element are provided with edge portions inserted in spaced slots provided in the periphery of supporting discs to maintain the foil in mounted position. Due to the inherently deformable nature of the flexible foil element problems are encountered in providing a satisfactory assembly of sufficient mechanical rigidity for mounting in the appliance. Further due to the relatively fragile character of the foil, other problems are encountered in handling the foil during manufacturing procedures to prevent damage thereto. It is required therefore that satisfactory procedural steps be provided for insuring that the foil is securely attached to the support means against accidental dislodgment or damage during assembly or use.

It is an object of the present invention to provide a novel heater assembly for an electrical applicance.

It is a further object to provide a novel heater assembly for an electrical hair dryer applicance having novel means for mounting a heater element on support means.

Another object is to provide a novel mounting arrangement for a foil type heater element having a novel mechanical inter-connection to a support assembly.

A further object is to provide a novel method for assembling a heater element to a support assembly.

A still further object is to provide a novel heater assembly and method for manufacture thereof which reduces manufacturing costs and assembly procedures.

SUMMARY OF THE INVENTION

The present invention comprehends a novel heater assembly for an electrical appliance. In the disclosed embodiment the heater assembly is adapted to be mounted in a portable electric hair dryer and comprises an elongated resistance foil strip mounted on spaced support members. The assembly is adapted to be mounted within a hair dryer over a motor driven impeller fan. The foil is provided with transversely extending integral vented vane portions which upon actuation of the motor and impeller direct air heated by the heater element through the heater element and outwardly of a discharge orifice in the appliance casing. The foil supporting means comprise a pair of spaced discs provided with recessed portions formed by teeth provided about the periphery thereof. Tab projections are provided on the longitudinally extending edges of the foil and are seated in the recessed portions. The tabs are provided with T-shaped locking means adapted to cooperate with detent portions formed on the support members adjacent the recessed portions for detenting the foil in mounted position.

The above and other objects and advantages of the present invention will appear more fully herinafter from a consideration of the detailed description which follows taken together with the accompanying drawings wherein one embodiment of the invention is illustrated.

DESCRIPTION OF THE DRAWINGS

In the drawings:

FIG. 5 is a fragmentary front elevational view of the heater assembly;

FIG. 6 is a sectional view taken on the line 6—6 of FIG. 5;

FIG. 7 is a sectional view taken on the line 7—7 of FIG. 8; and

FIG. 8 is an enlarged sectional view taken on the line of 8—8 of FIG. 1 showing the heater element in mounted position within the hair dryer.

DETAILED DESCRIPTION

Figure 1:
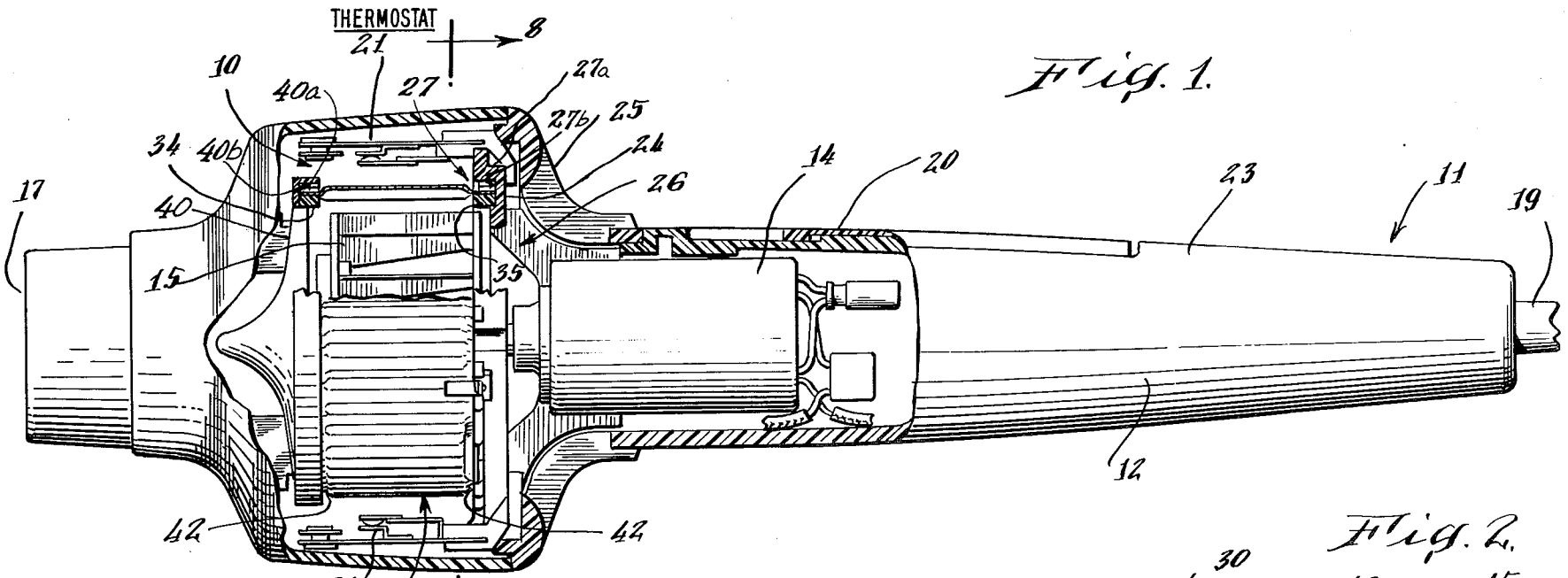
FIG. 1 is a side elevational view of a hair dryer embodying the present invention with parts of the casing thereof broken away to show the interior thereof.

Referring now to the drawings for a more detailed description of the present invention and more particularly to FIG. 1 a novel heater assembly made according to the present invention is generally indicated by the reference numeral 10. Heater assembly 10 is shown in FIG. 1 as mounted within a hair dryer device 11 whose casing is generally indicated by the reference numeral 12.

Hair dryer 11 includes within casing 12 a suitable motor 14 and a fan impeller 15 disposed axially of heater assembly 10. The forward end of casing 12 is provided with an air discharge orifice 17 through which air heated by heater assembly element 10 is discharged upon operation of fan impeller 15 by motor 14 in a known manner. Motor 14 and heater assembly 10 are provided with means for connection to a suitable source of external electrical power via power cord 19 and utilization of on-off switch 20 and which elements do not provide part of the present invention. In addition thermostats 21 are provided in circuit with heater assembly 10 in a usual manner to control operation of dryer 11 and the temperature of the air heated thereby.

Casing 12 is preferably formed from a suitable hard premolded plastic material such as that sold under the trademark LEXAN. Casing 12 includes an elongated handle portion 23 and a forward base portion 24 (FIGS.

1 and 8) separated from handle 23 by spaced ribs 25 which provide therebetween air intake vents 26. The base portion 24 is provided with a flanged area 27 on which is mounted one end of heater assembly 10 in a manner to be hereinafter described.

Figure 3:
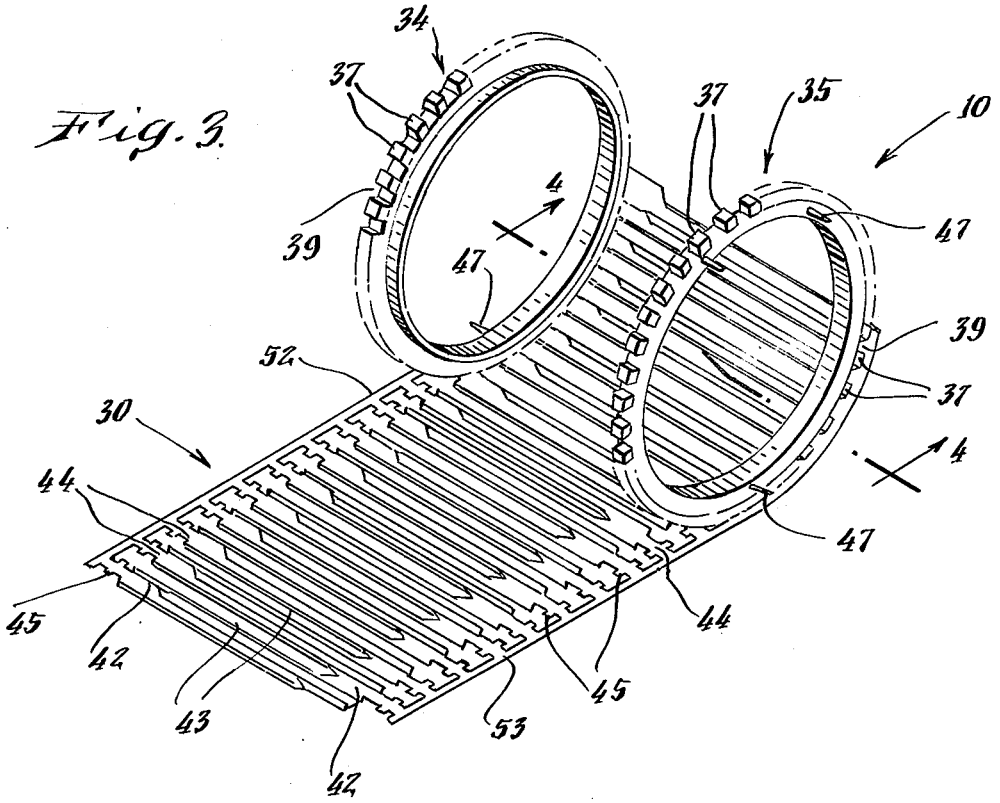
FIG. 3 is a perspective view of the heater element of FIG. 2 in the process of being mounted on the support means therefor.
Figure 4:
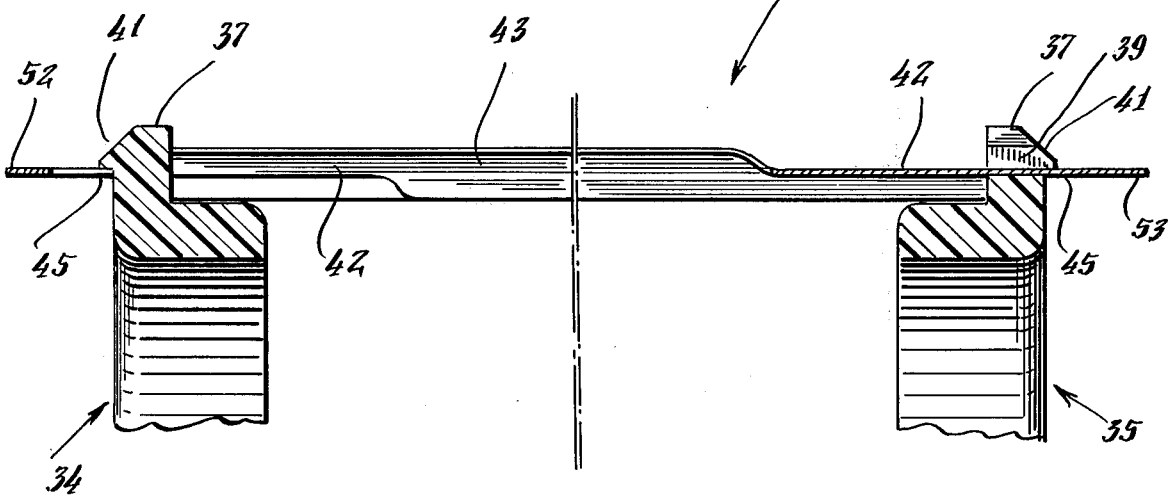
FIG. 4 is a sectional view taken on the line 4—4 of FIG. 3.

As mentioned it is a feature of the present invention to provide a novel heater assembly 10. To this end heater assembly 10 (FIG. 3 to 8) comprises an elongated high resistance flexible metal alloy element 30 and support means therefor. The support means as illustrated in FIG. 3 comprise a pair of spaced discs 34–35 formed of a suitable ceramic or high temperature resistance plastic material. Spaced teeth 37 are formed about the periphery of discs 34–35 and provide therebetween a plurality of recessed portions or notches 39. Detent means for locking heater element 30 to discs 34–35 are provided adjacent recessed portions 39 beneath teeth 37 and include lip portions 41 (FIGS. 4 and 6) projecting away from the periphery of dics 34–35.

Flexible heater element 30 is readily deformable and is of the type provided with transverse integral rib portions 42 provided with integral arcuate vanes 43 for directing the air flow from impeller 15 in a known manner. Ribs 42 are interconnected at their ends to form a continuous resistance element for incorporation into the electric circuit of dryer 11. Heater element 30 is provided with laterally extending tabs 44 each seated in a recessed portion 39 between teeth 37. T-shaped end portions 45 are formed on tabs 44 and are disposed beneath lips 41 thereby detenting heater element 30 to support discs 34–35 with end portion 45 folded down against the adjacent surfaces of discs 34–35.

Heater assembly 10 comprising element 30 mounted on discs 34–35 is located in hair dryer casing 12 by means of projections 47 on disc 35 (FIGS. 3 & 7). Projections 47 are inserted in apertures 48 in base section 24 and fixed thereto by heat melting the ends thereof. In addition L-shaped terminals 50 are provided at selected intervals along the length of foil element 30 to provide means for interconnecting element 30 to the appliance electrical circuit (not shown) and for selectively controlling the activation thereof during operation of hair dryer 11 over selective temperature ranges as desired by the user in a usual manner.

Figure 2:
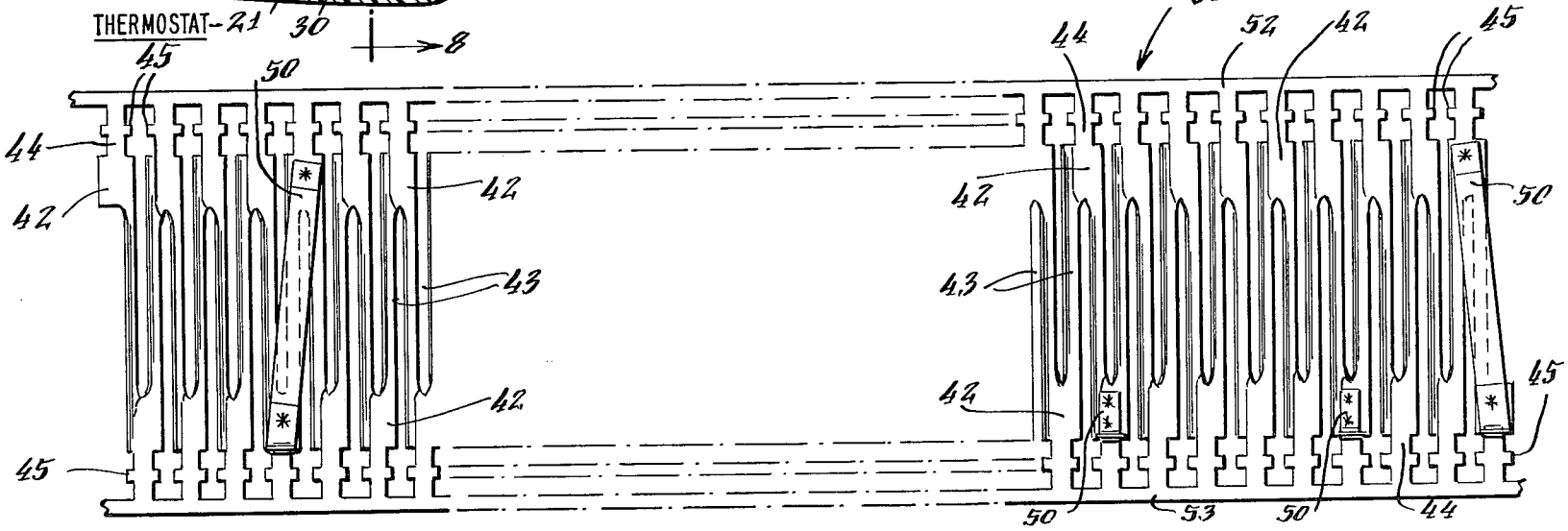
FIG. 2 is a fragmentary view of an elongated heater foil type element.

It is also a feature of the present invention to provide novel means for assembling heater assembly 10 to disc members 34–35. As seen in FIG. 2 foil strip 30 prior to assembly to disc 34–35 include additional border edge surfaces 52 and 53 extending longitudinally thereof. During assembly discs 34–35 are held in position by a suitable fixture device (not shown) and a predetermined length of foil 30 sufficient for 360°encirclement of disc 34–35 is precut and wound about spaced discs 34–35. As foil 30 is wound tabs 44 engage in recessed portions 39.

The T-end portions 45 are positioned beneath lips 41 detenting foil 30 to discs 34–35. Border portions 52–53 are then cut from foil 30 and the remaining end of tabs 44 (FIGS. 6–7) are pressed downwardly against the adjacent surfaces of discs 34–35. If desired a suitable source of heat may be applied to the surfaces of discs 34–35 adjacent recessed portions 39 to deform the plastic about tabs 44 to further secure tabs 44 in position. Disc 35 is then aligned with flange area 27 of base member 24 of dryer 11 and projections 47 are inserted in apertures 48. Disc member 35 in flange area 27 (FIGS 1 and 7) is further provided with means for containing tabs 44 within recesses 39. The containing means comprise an annular member 27*a* having one side 27*b* contacting and cooperating with teeth 37 around the periphery of disc member 35 to prevent dislodgment of tabs 44 from recesses 39. A similar containing means is provided around disc member 34 (FIG. 1). Disc member 34 is mounted on a cone-shaped air directing support 40 located adjacent air exhaust orifice 17 of casing 12. Support 40 is provided with an annular member 40*a* having one side 40*b* contacting and cooperating with teeth 37 around the periphery of disc member 34 to prevent dislodgement of tabs 44 from recesses 39 on disc member 34. In this manner heater assembly 10 is readily formed and mounted in hair dryer 10 with terminals 50 suitably connected in a manner not shown to the electric circuit of the applicance.

It will be apparent from the foregoing description that the novel heater assembly 10 has many advantages and includes among others the provision of secure detenting means for holding a relatively fragile and deformable heater foil in position on spaced support elements. In addition the novel configuration of the foil in cooperation with the detent means on the spaced support members allows for ready assembly of the foil to the support members with a minimum chance of damage and deformation and lends itself to automated manufacturing procedures.

Although one embodiment of the present invention is illustrated and described in detail it is to be expressly understood that the invention is not limited thereto. Various changes can be made in the design and arrangement of parts without departing from the spirit and scope of the invention as the same will now be understood by those skilled in the art.

What is claimed is:

1. An elongated cylindrical-shaped electrical heater assembly comprising, a. a pair of spaced disc members, b. a plurality of spaced teeth formed around the periphery of each of said disc members, c. a cylindrical-shaped heater element extending between said disc members and formed of a flexible electrical resistance foil strip having a plurality of transverse ribs interconnected at their end portions to form a continuous resistance element, said ribs each having an air directing vane formed therein between said end portions, said end portions being mounted on the periphery of said disc members in engagement with said teeth, d. means contacting and cooperating with the teeth around the periphery of at least one of said disc members for containing said end portions lying between said teeth of said at least one disc member to prevent dislodgment of said end portions from said at least one disc member, and e. said at least one disc member having a central opening to permit airflow through the interior of said cylindrical heater assembly.

2. The heater assembly of claim 1 wherein the end portions of said heater element are provided by a plurality of interconnected spaced T-shaped ends disposed in the space between the teeth of said disc members, said T-shaped ends and said ribs having opposed surfaces engaging therebetween portions of said teeth to prevent lateral movement of said heater element relative to said disc members.

3. The heater assembly of claim 2 wherein projection means are formed on said teeth of said disc members for holding said T-shaped ends to said disc members.

4. The heater assembly of claim 3 wherein said projection means include lip portions which extend from said teeth to engage said T-shaped end.

5. The heater assembly of claim 4 wherein the stem portion of said T-shaped ends lie within notches defined by said spaced teeth and the transversely extending cross-bar portion of said T-shaped ends are in engagement with said lip portions.

6. An elongated cylindrical-shaped heater assembly comprising, a. a pair of spaced disc members, b. a plurality of spaced teeth formed around the periphery of each of said disc members, c. a plurality of notches defined by said spaced teeth, d. a cylindrical-shaped heater element extending between said disc members and formed of a flexible electrical resistance foil strip having a plurality of transverse ribs interconnected at their end portions to form a continuous resistance elements, said ribs each having an air directing vane formed therein between, e. said ribs each having a pair of shoulders between said end portions and said vane, said end portions being T-shaped and having a cross-bar portion and a stem portion, the stem portion joining the shoulders of said ribs and the cross-bar portion being spaced from said shoulders, f. said stem portion being seated in said notches, while said cross-bar portion and said shoulders engage therebetween portions of said teeth for preventing lateral movement of said heater element relative to said disc members, g. means cooperating with said teeth of at least one of said disc members for containing said stem portion within said notches to prevent dislodgment of said stem portion from said at least one dsic member, and h. said at least one disc member having a central opening to permit airflow through the interior of said cylindrical heater assembly.

7. The heater assembly of claim 6 wherein said containing means includes an annular member carried by said at least one disc member, said annular member having one side contacting said teeth of said at least one disc member to contain said stem portion.

8. In an electrical appliance including in combination, a casing having air intake vents and an air discharge orifice spaced from said intake vents, a mounting member located within said casing between said intake vents and said discharge orifice, airflow generating means mounted in axial alignment with said mounting member, a cylindrical-shaped heater assembly mounted in axial alignment with said airflow operating means and comprising a pair of spaced disc members having a central opening therein to permit airflow therethrough, a cylindrical-shaped heater element extending between said disc members and formed of a flexible electrical resistance foil strip having a plurality of transverse ribs interconnected at their end portions to form a continuous resistance element, said ribs each having an air directing vane formed therein between said end portions, said end portions mounted on the periphery of said disc members, said airflow generating means being operable for generating an airstream in said casing from said intake vents through said heater assembly to said exhaust orifice and outwardly of said casing, the improvement comprising, a. a plurality of spaced teeth formed around the periphery of each of said disc members, b. said end portions of said heater element being mounted in engagement with said teeth, and c. means cooperating with and contacting said teeth around the periphery of at least one of said disc members for containing said end portions lying between the teeth of said at least one disc member to prevent dislodgment of said end portions from said at least on disc member.

9. The appliance of claim 8 wherein securing means are formed on one of said disc members for attaching said heater assembly to said mounting member between said mounting member and said exhaust orifice in axial alignment with said airflow generating means.

10. The appliance of claim 9 wherein said mounting member includes a flange area having engagement means formed therein for mating engagement with said securing means.

11. The appliance of claim 10 wherein said securing means include spaced projections on said one disc member and said engagement means include apertures formed in the flanged area of said mounting means.

* * * * *

UNITED STATES PATENT OFFICE

CERTIFICATE OF CORRECTION

Patent No. 4,066,865 Dated January 3, 1978

Inventor(s) Siegfried Godel, et al

It is certified that error appears in the above-identified patent and that said Letters Patent are hereby corrected as shown below:

IN THE CLAIMS

Claim 6, paragraph d., line 19, after "resistance" cancel "elements" and insert -- element -- therefor.

Claim 8, paragraph c., line 32, after "least" cancel "on" and insert -- one -- therefor.

Signed and Sealed this

Ninth Day of May 1978

[SEAL]

Attest:

RUTH C. MASON
Attesting Officer

LUTRELLE F. PARKER
Acting Commissioner of Patents and Trademarks